US008781844B2

(12) United States Patent
Laaksonen et al.

(10) Patent No.: US 8,781,844 B2
(45) Date of Patent: Jul. 15, 2014

(54) AUDIO CODING

(75) Inventors: Lasse Juhani Laaksonen, Nokia (FI); Mikko Tapio Tammi, Tampere (FI); Adriana Vasilache, Tampere (FI); Anssi Sakari Ramo, Tampere (FI)

(73) Assignee: Nokia Corporation, Espoo (FI)

( * ) Notice: Subject to any disclaimer, the term of this patent is extended or adjusted under 35 U.S.C. 154(b) by 196 days.

(21) Appl. No.: 13/497,934

(22) PCT Filed: Sep. 25, 2009

(86) PCT No.: PCT/EP2009/062475

§ 371 (c)(1),
(2), (4) Date: Apr. 16, 2012

(87) PCT Pub. No.: WO2011/035813

PCT Pub. Date: Mar. 31, 2011

(65) Prior Publication Data

US 2012/0197649 A1 Aug. 2, 2012

(51) Int. Cl.

| | |
|---|---|
| ***G10L 19/00*** | (2013.01) |
| ***G10L 21/038*** | (2013.01) |
| ***G10L 19/02*** | (2013.01) |

(52) U.S. Cl.

CPC ..... *G10L 19/0208* (2013.01); *G10L 21/038* (2013.01)

USPC ..... 704/500; 704/501; 704/258; 704/226; 704/219; 704/211; 704/206; 704/205; 704/203; 704/201; 702/181; 341/120

(58) Field of Classification Search

CPC ... G10L 19/24; G10L 21/038; G10L 19/0017; G10L 19/0204; H04N 19/00569; H04N 19/00818

USPC ..... 704/500, 201, 206, 203, 258, 226, 219, 704/211, 205; 702/181; 341/120

See application file for complete search history.

(56) References Cited

U.S. PATENT DOCUMENTS

| | | | | |
|---|---|---|---|---|
| 6,021,383 | A * | 2/2000 | Domany et al. | 702/181 |
| 6,407,685 | B1 * | 6/2002 | Handel et al. | 341/120 |
| 6,445,317 | B2 * | 9/2002 | Lundin et al. | 341/120 |
| 6,502,069 | B1 * | 12/2002 | Grill et al. | 704/219 |
| 6,704,711 | B2 * | 3/2004 | Gustafsson et al. | 704/258 |
| 6,988,066 | B2 * | 1/2006 | Malah | 704/219 |
| 7,239,999 | B2 * | 7/2007 | Rhee | 704/211 |
| 7,246,065 | B2 * | 7/2007 | Tanaka et al. | 704/500 |

(Continued)

FOREIGN PATENT DOCUMENTS

| | | | |
|---|---|---|---|
| EP | 2 017 830 | A1 | 1/2009 |
| WO | WO 2007/052088 | A1 | 5/2007 |
| WO | WO 2007/072088 | A1 | 6/2007 |
| WO | WO 2009/059631 | | 5/2009 |

*Primary Examiner* — Michael Colucci

(74) *Attorney, Agent, or Firm* — Harrington & Smith

(57) ABSTRACT

A method for encoding an audio signal including: processing a selected subset of a lower series of samples forming a lower frequency spectral band of the audio signal and a higher series of samples forming a higher frequency spectral band of the audio signal to parametrically encode the higher series of samples forming the higher frequency spectral band by identifying a sub-series of the lower series of samples.

16 Claims, 4 Drawing Sheets

(56) References Cited

U.S. PATENT DOCUMENTS

| | | | | |
|---|---|---|---|---|
| 7,469,206 | B2 * | 12/2008 | Kjorling et al. | 704/205 |
| 7,620,554 | B2 * | 11/2009 | Ojanpera | 704/500 |
| 7,725,311 | B2 * | 5/2010 | Bourokba et al. | 704/219 |
| 7,953,605 | B2 * | 5/2011 | Sinha et al. | 704/501 |
| 8,265,940 | B2 * | 9/2012 | Geiser et al. | 704/500 |
| 8,463,603 | B2 * | 6/2013 | Gao | 704/226 |
| 2005/0096917 | A1 * | 5/2005 | Kjorling et al. | 704/500 |
| 2008/0312912 | A1 * | 12/2008 | Choo et al. | 704/203 |
| 2009/0192789 | A1 * | 7/2009 | Lee et al. | 704/206 |
| 2010/0063802 | A1 * | 3/2010 | Gao | 704/201 |
| 2010/0070284 | A1 * | 3/2010 | Oh et al. | 704/500 |

* cited by examiner

AUDIO CODING

FIELD OF THE INVENTION

Embodiments of the present invention relate to audio coding. In particular, they relate to coding high frequencies of an audio signal utilizing the low frequency content of the audio signal.

BACKGROUND TO THE INVENTION

Audio encoding is commonly employed in apparatus for storing or transmitting a digital audio signal. A high compression ratio enables better storage capacity or more efficient transmission through a channel. However, it is also important to maintain the perceptual quality of the compressed signal.

There may be good correlation between a low frequency region and a higher frequency region of an audio signal. This may be utilized for example by using a bandwidth extension technique, which instead of encoding the signal of the high frequency region aims to model the high frequency region by using a copy of a signal at the low frequency region and adjusting the copied spectral envelope to match the high frequency region. Another example is spectral band replication (SBR) coding, which proposes that a higher frequency spectral band should not itself be coded/decoded but should be replicated based on a pre-selected segment from a decoded lower frequency spectral band. However, these methods only try to maintain the overall shape of the spectral envelope at the high frequency region, whereas the fine structure of the original spectrum, which may be quite different is not considered.

An intermediate form between conventional spectral coding and bandwidth extension is to adaptively copy selected portions of a lower frequency spectral band to model the higher frequency spectral band. WOO7072088 teaches dividing the higher frequency spectral band into smaller spectral sub bands. During encoding, systematic searches are used to find the portions of the larger lower frequency spectral band of the audio signal that are most similar to the smaller higher frequency spectral sub bands. A higher frequency spectral sub band can then be parametrically encoded by providing a parameter that identifies the most similar portion of the larger lower frequency spectral band. The searches may be computationally intensive. At decoding, the provided parameter is used to replicate the appropriate portions of the lower frequency spectral band in the appropriate higher frequency spectral sub bands.

BRIEF DESCRIPTION OF VARIOUS EMBODIMENTS OF THE INVENTION

According to various, but not necessarily all, embodiments of the invention there is provided a method comprising: processing a selected subset of a lower series of samples forming a lower frequency spectral band of the audio signal and a higher series of samples forming a higher frequency spectral band of the audio signal to parametrically encode the higher series of samples forming the higher frequency spectral band by identifying a sub-series of the selected subset of the lower series of samples.

According to various, but not necessarily all, embodiments of the invention there is provided a system comprising: an encoding apparatus configured to process a selected subset of a lower series of samples forming a lower frequency spectral band of an audio signal and a higher series of samples forming a higher frequency spectral band of the audio signal to parametrically encode the higher series of samples forming the higher frequency spectral band by identifying, using a parameter, a sub-series of the lower series of samples; and a decoding apparatus configured to replicate the higher series of samples forming the higher frequency spectral band using the sub-series of the lower series of samples identified by the parameter.

According to various, but not necessarily all, embodiments of the invention there is provided an apparatus comprising: circuitry configured to process a selected subset of a series of samples forming a lower frequency spectral band of an audio signal and a series of samples forming a higher frequency spectral band of the audio signal to parametrically encode the series of samples forming the higher frequency spectral band by identifying a sub-series of the selected subset of the lower series of samples.

According to various, but not necessarily all, embodiments of the invention there is provided an apparatus comprising: processing means for processing a selected subset of a series of samples forming a lower frequency spectral band of an audio signal and a series of samples forming a higher frequency spectral band of the audio signal to parametrically encode the series of samples forming the higher frequency spectral band by identifying a sub-series of the selected subset of the lower series of samples.

According to various, but not necessarily all, embodiments of the invention there is provided a computer program which when run on a processor enables the processor to process a selected subset of a series of samples forming a lower frequency spectral band of an audio signal and a series of samples forming a higher frequency spectral band of the audio signal to parametrically encode the series of samples forming the higher frequency spectral band by identifying a sub-series of the selected subset of the lower series of samples.

According to various, but not necessarily all, embodiments of the invention there is provided a computer program which when run on a processor enables the processor to select a subset of a lower series of samples in the frequency domain that form a lower frequency spectral band of an audio signal; search the selected subset of the lower series of samples using a higher series of samples in the frequency domain forming a higher frequency spectral band of the audio signal to select a sub-series of the selected subset of the lower series of samples; and parametrically encode the higher series of samples by identifying the selected sub-series of the subset of the lower series of samples.

According to various, but not necessarily all, embodiments of the invention there is provided a module comprising: circuitry configured to process a selected subset of a series of samples forming a lower frequency spectral band of an audio signal and a series of samples forming a higher frequency spectral band of the audio signal to parametrically encode the series of samples forming the higher frequency spectral band by identifying a sub-series of the selected subset of the lower series of samples.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
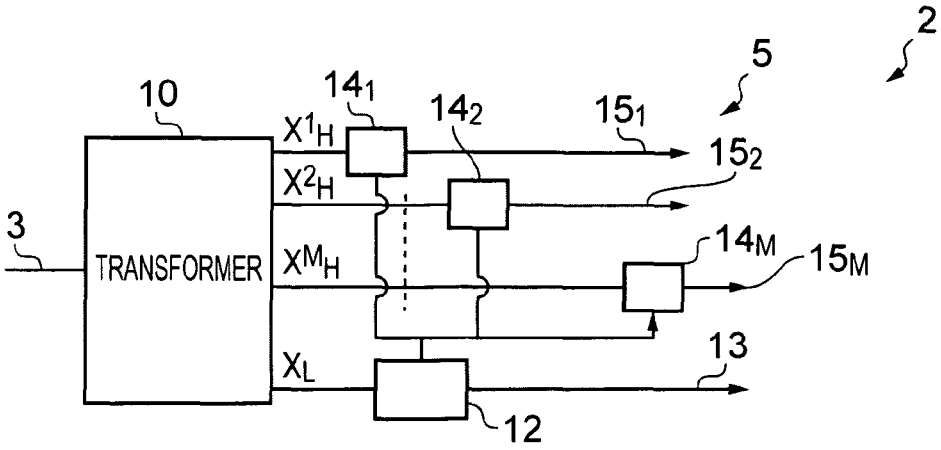
FIG. 1 schematically illustrates an audio encoding apparatus.

FIG. 1 schematically illustrates an audio encoding apparatus 2. The audio encoding apparatus 2 processes digital audio 3 to produce encoded data 5 that represents the digital audio using less information. The information content of the digital audio signal 3 is compressed to encoded data 5.

Figure 4:
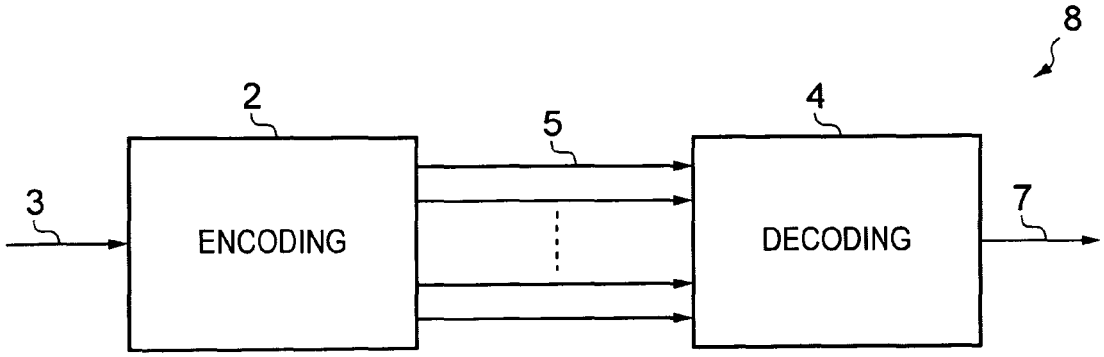
FIG. 4 schematically illustrates a system comprising an audio encoding apparatus and an audio decoding apparatus.

FIG. 4 illustrates the audio encoding apparatus 2 in a system 8 that also comprises an audio decoding apparatus 4. The audio decoding apparatus 4 processes the encoded data 5 to produce digital audio 7. Although the digital audio 7 comprises less information than the original digital audio 3, the encoding and decoding processes are designed to maintain perceptually high quality audio. This may, for example, be achieved by using a psychoacoustic model for encoding/decoding a lower frequency spectral band of the digital audio and using a coding technique making use of the lower frequency spectral band for encoding/decoding a higher spectral band.

Referring back to FIG. 1, the audio encoding apparatus 2 comprises: a transformer block 10 for converting the digital audio 3 from the time domain into the frequency domain, an audio coding block 12 for encoding a lower frequency spectral band of the digital audio; and one or more parametric coding blocks 14 for parametrically encoding one or more higher frequency spectral bands of the digital audio.

Transformer

The transformer 10 receives as input the time domain digital audio 3 and produces as output a series X of N samples representing the spectrum of the digital audio.

A lower series $X_L(k)$ of the N samples k=1, 2 . . . L represents a lower frequency spectral band of the digital audio.

One or more higher series $X_H^j(k)$ of the N samples, where j=1, . . . , M, and where k=0, 1, 2 . . . $n_j$ represent one or more higher frequency spectral bands of the digital audio. $n_j$ may be a constant or some function of j.

Figure 3:
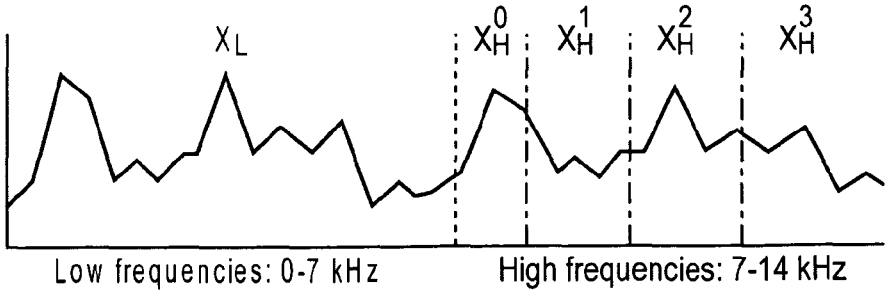
FIG. 3 schematically illustrates a spectrum of the audio signal.

FIG. 3 schematically illustrates a spectrum of the audio signal including a lower series $X_L(k)$ and four higher series $X_H^j(k)$, where j=0, 1, 2 and 3.

The boundaries of the lower series $X_L(k)$ and the one or more higher series $X_H^j(k)$ may overlap in some embodiments and not overlap in other embodiments. In the following described embodiments they do not overlap.

The boundaries of the one or more higher series $X_H^j(k)$ may overlap in some embodiments and not overlap in other embodiments. In the following described embodiments they do not overlap.

The size $n_j$ of a higher series $X_H^j(k)$ of samples may be less than the size L of the lower series $X_L(k)$ of samples e.g. $n_j<L$ for all j.

The whole of the series X may be spanned by the lower series $X_L(k)$ and the one or more higher series $X_H^j(k)$ e.g.

$$N = L + \sum_{j=1}^{M} n_j.$$

The transformer block 10 may use a modified discrete cosine transform. Other transforms which represent signal in frequency domain with real-valued coefficients, such as discrete sine transform, can be utilized as well.

Audio Coding

The audio coding block 12 in this example may use a psychoacoustic model to encode the lower series of samples $X_L(k)$ to produce encoded audio 13. The encoded audio may be a component of the encoded data 5.

The audio encoding block 12 may also decode the encoded audio 13 to produce a synthesized lower series $\hat{X}_L(k)$ which represents the lower series of samples $X_L(k)$ available at a decoding apparatus 4. The synthesized lower series $\hat{X}_L(k)$ may be psycho-acoustically equivalent to the lower series of samples $X_L(k)$. In some embodiments the synthesized lower series $\hat{X}_L(k)$ may be psycho-acoustically as similar as possible to the lower series of samples $X_L(k)$, given the constraints imposed for example to bit-rate of encoded data, processing resources used by the encoding process, etc.

Coding Higher Frequencies

Figure 2:
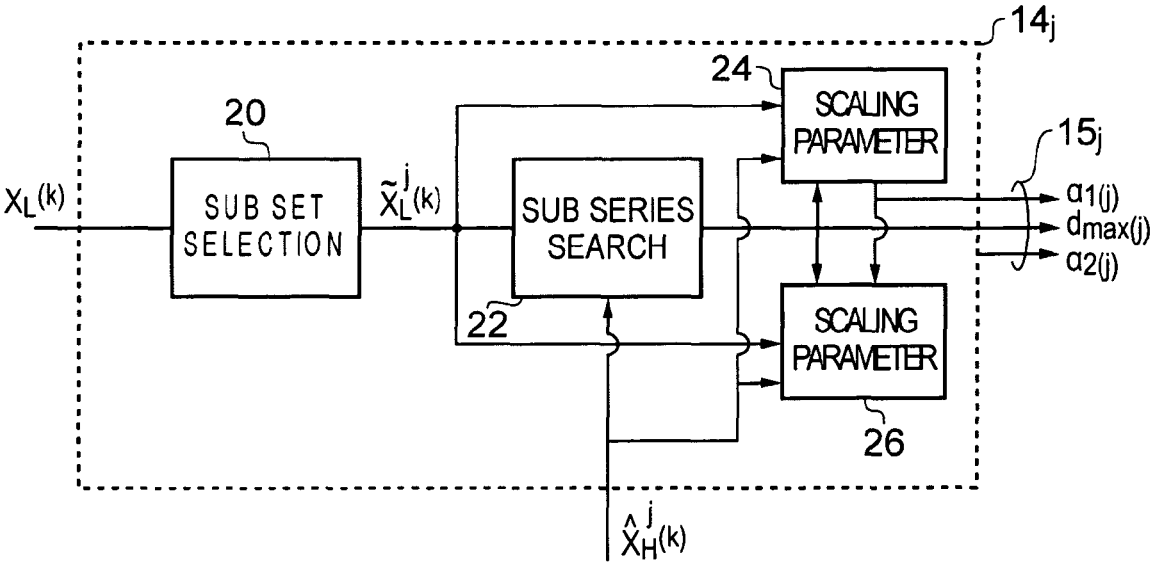
FIG. 2 schematically illustrates a parametric coding block.

The parametric coding blocks $\mathbf{14}_j$ parametrically encode the higher frequency spectral bands $X_H^j(k)$ of the digital audio. The output of each of the parametric coding blocks $\mathbf{14}_j$ is a set of parameters representing the higher frequency band $\mathbf{15}_j$. The parameters representing the higher frequency band $\mathbf{15}_j$ may be components of the encoded data 5. An example of a parametric coding block 14 is schematically illustrated in FIG. 2.

One input to the coding block $\mathbf{14}_j$ is the higher series $X_H^j(k)$ of samples representing the higher frequency spectral band j of the digital audio.

Another input to the coding block $\mathbf{14}_j$ is the lower series of samples representing the lower frequency spectral band of the digital audio. The input lower series of samples may be in some embodiments the original lower series of samples $X_L(k)$. In other embodiments it may be the synthesized lower series of samples $\hat{X}_L(k)$. Let us assume for the purpose of the description of this example that the lower series of samples representing the lower frequency spectral band of the digital audio is the synthesized lower series of samples $\hat{X}_L(k)$.

In the following description, reference will be made to controlling the search by limiting the range of the lower series of samples $\hat{X}_L(k)$ available for searching to a subset $\tilde{X}_L^j(k)$ of the lower series of samples $X_L^j(k)$. The subset $\tilde{X}_L^j(k)$ may be the same or different for each of the higher frequency sub-bands j. In the following described examples, the control of the range of the lower series of samples $\hat{X}_L(k)$ searched occurs within the respective coding blocks $\mathbf{14}_j$. In other embodiments, the control of the range of the lower series of samples $\hat{X}_L(k)$ searched occurs by controlling the range of the lower series of samples $\hat{X}_L(k)$ input to the respective coding blocks $\mathbf{14}_j$. Therefore the limitation of the range of the lower series of samples $\hat{X}_L(k)$ may occur either within the coding blocks $\mathbf{14}_j$ or elsewhere.

Referring to FIG. 2, the parametric coding block $\mathbf{14}_j$ may comprise a subset selection block 20 for selecting a subset $\tilde{X}_L^j(k)$ of the lower series of samples $X_L^j(k)$ and a sub-series search block 22 for finding a 'matching' sub-series of the subset $\tilde{X}_L^j(k)$ of the lower series of samples $\hat{X}_L(k)$ that is suitable for coding the higher series of samples $X_H^j(k)$. Selection of the subset $\tilde{X}_L^j(k)$ may be dependent on the input higher series $X_H^j(k)$ of samples. That is the subset is dependent on the higher frequency sub-band index j.

The selection of a subset $\tilde{X}_L^j(k)$ of the lower series of samples $X_L^j(k)$ and the use of that subset $\tilde{X}_L^j(k)$ in determining the matching sub-series of the lower series of samples significantly reduces the number of calculations required compared to if, instead of using the subset $\tilde{X}_L^j(k)$ of the lower series of samples, the whole lower series of samples $\hat{X}_L(k)$ is used to determine the matching sub-series of the lower series of samples.

Many different methodologies may be used for the selection of the subset $\tilde{X}_L^j(k)$ of the lower series of samples $\hat{X}_L(k)$. The subset selection block 20 may use a predetermined methodology for selecting the subset. Alternatively, the subset selection block 20 may select which one of a plurality of different methodologies is used.

A number of different possible implementations for selection of the subset $\tilde{X}_L^j(k)$ are described later.

Processing

The sub-series search block 22 processes the selected subset $\tilde{X}_L^j(k)$ of the lower series of samples $\hat{X}_L(k)$ and the higher series of samples $X_H^j(k)$ to parametrically encode the higher series of samples $X_H^j(k)$ by identifying a 'matching' sub-series of the lower series of samples.

The sub-series search block 22 determines a similarity cost function S(d), that is dependent upon the higher series of samples $X_H^j(k)$ and a putative sub-series $\tilde{X}_L^j(k+d)$ of the selected subset $\tilde{X}_L^j(k)$ of the lower series of samples, for each one of a plurality of putative sub-series of the selected subset $\tilde{X}_L^j(k)$ of the lower series.

It selects the best sub-series $\tilde{X}_L^j(d)=\tilde{X}_L^j(k+d)$ by choosing the putative sub-series $\tilde{X}_L^j(k+d)$ of the selected subset $\tilde{X}_L^j(k)$ of the lower series having the best similarity cost function S(d). It identifies the position of the selected putative sub-series $\tilde{X}_L^j(k+d)$ either within the lower series of samples $\hat{X}_L(k)$ or within the selected subset $\tilde{X}_L^j(k)$ of the lower series using a parameter (d).

Figure 7:
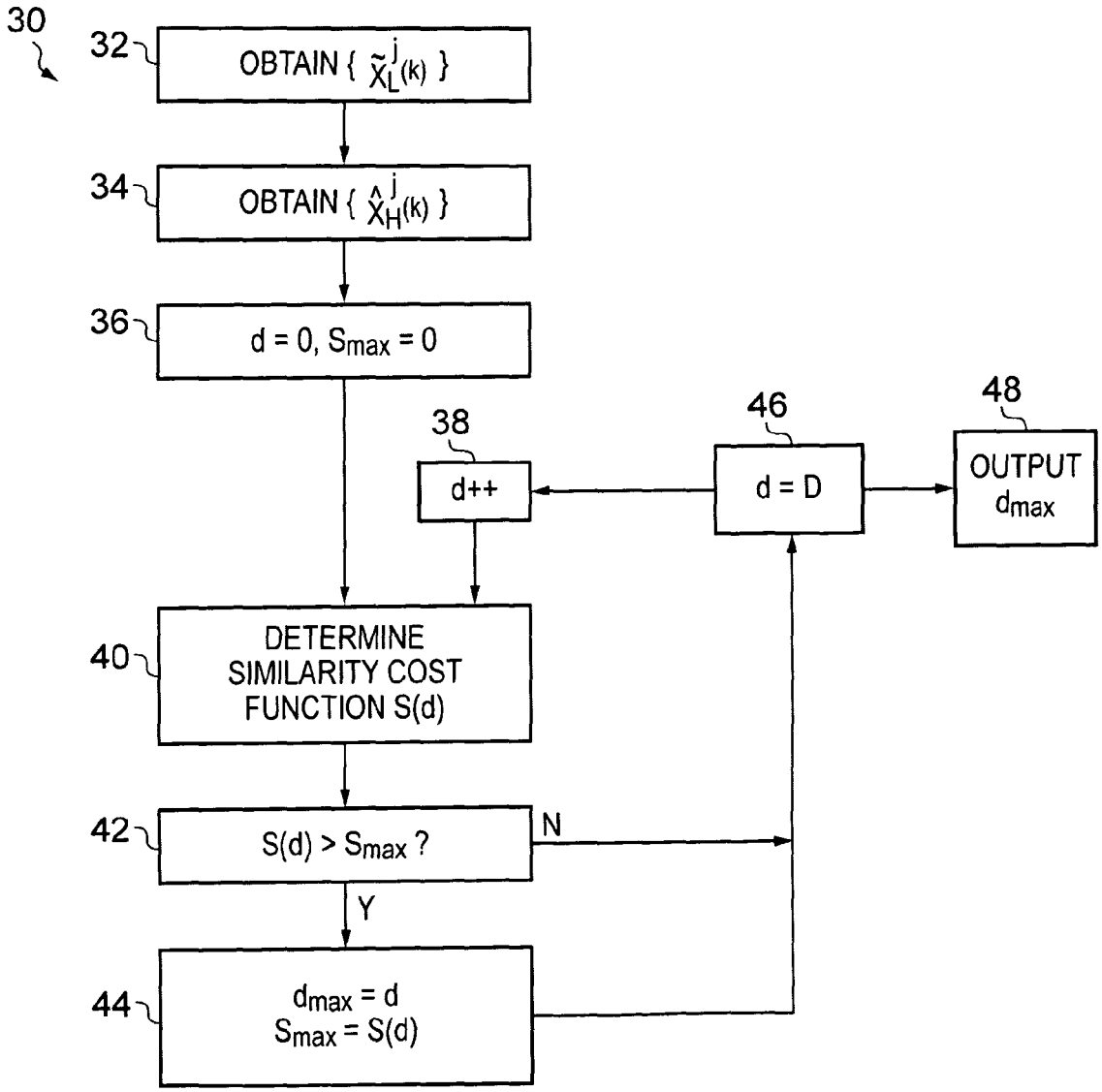
FIG. 7 schematically illustrates a method of processing a selected subset of a higher series of samples and a lower series of samples to parametrically encode the higher series of samples by identifying a sub-series of the lower series of samples.

An example of a suitable method 30 is illustrated in FIG. 7.

At block 32, the subset $\tilde{X}_L^j(k)$ of the lower series of samples $X_L^j(k)$ is selected and obtained. The lower series of samples $X_L^j(k)$ is obtained from either the transformer block 10, in the example of FIG. 1, or in synthesized form from the coding block 12.

At block 34, the higher series of samples $X_H^j(k)$ is obtained from, in the example of FIG. 1, the transformer 10.

At block 36, initialization of the search loop occurs. d is set to 0. $S_{max}$ is set to zero. $d_{max}$ is set to zero.

The value d determines the putative sub-series $\tilde{X}_L^j(k+d)$ of the subset $\tilde{X}_L^j(k)$ of the lower series of samples $\hat{X}_L(k)$.

At block 40, a similarity cost function S(d) that is dependent upon the higher series of samples $X_H^j(k)$ and the current putative sub-series $\tilde{X}_L^j(k+d)$ of the subset $\tilde{X}_L^j(k)$ of the lower series of samples is determined.

One example of a similarity cost function is the inverse of the Euclidian distance, another example is the normalized correlation. Equation (1A) expresses an example of the similarity cost function as a cross-correlation.

$$S(d) = \left| \frac{\sum_{k=0}^{n_j-1} \left( X_H^j(k) \tilde{X}_L(d+k) \right)}{\sqrt{\sum_{k=0}^{n_j-1} \tilde{X}_L(d+k)^2}} \right|. \tag{1A}$$

Equation (1B) expresses another example of the similarity cost function as a normalized cross-correlation.

$$S(d) = \left| \frac{\sum_{k=0}^{n_j-1} \left( X_H^j(k) \tilde{X}_L(d+k) \right)}{\left[ \sum_{k=0}^{n_j-1} \tilde{X}_L(d+k) \right]^2} \right|. \tag{1B}$$

In (1A) $n_j$ is the length of the $j^{th}$ higher frequency sub band $X_H^j(k)$.

The similarity cost function is a function of the subset $\tilde{X}_L^j(k)$ of the lower series of samples $\hat{X}_L(k)$ as opposed to being a function of the whole lower series of samples $\hat{X}_L(k)$.

In this example, the similarity cost function, comprises processing of each of the samples in the higher frequency sub-band $X_H^j(k)$ with the respective corresponding sample in the putative sub-series $\tilde{X}_L^j(k+d)$ of the subset $\tilde{X}_L^j(k)$ of the lower series of samples $\hat{X}_L(k)$.

At block 42, if the current putative sub-series $\tilde{X}_L^j(k+d)$ of the lower series has a better similarity cost function S(d) than the current value of $S_{max}$, then the method moves to block 44 otherwise it moves to block 46.

At block 44, the current best sub-series $\tilde{X}_L^j(d_{max})=\tilde{X}_L^j(k+d_{max})$ is updated by setting $d_{max}(j)=d$ and $S_{max}=S(d)$. The method then moves to block 46.

At block 46, if the search has completed (d=D), the method moves to block 48. Otherwise the method moves to block 38, where d is incremented by one. and a new current putative sub-series $\tilde{X}_L^j(k+d)$ is defined for the search loop.

At block 48, the position of the selected putative sub-series $\tilde{X}_L^j(k+d_{max})$ within the lower series is identified using the parameter $d_{max}(j)$ The range of allowed d values (number of search loops) can be quite large (for example up to 256 different values) and thus a large number of S(d) values are computed in the loop of FIG. 7. The numerator of (1A) & (1B), requires $n_j$ multiplications as well as $n_j-1$ additions for every d. Thus the numerator of (1A) & (1B) is a source of complexity. With the proposed method as the subset $\tilde{X}_L^j(k)$ of the lower series of samples $\hat{X}_L(k)$ is of reduced size compared to the lower series of samples $\hat{X}_L(k)$ the search is simplified.

The reduced subset $\tilde{X}_L^j(k)$ may be achieved by selecting the range of samples in the lower series of samples $\hat{X}_L(k)$ that are most probably the perceptually most important.

If considering a first high frequency band and a second high frequency band, which are adjacent in frequency, a first low frequency sub-series that provides a good match with the first high frequency band and a second low frequency sub-series that provides a good match with the second high frequency band are likely to be found in close proximity.

Figure 8:
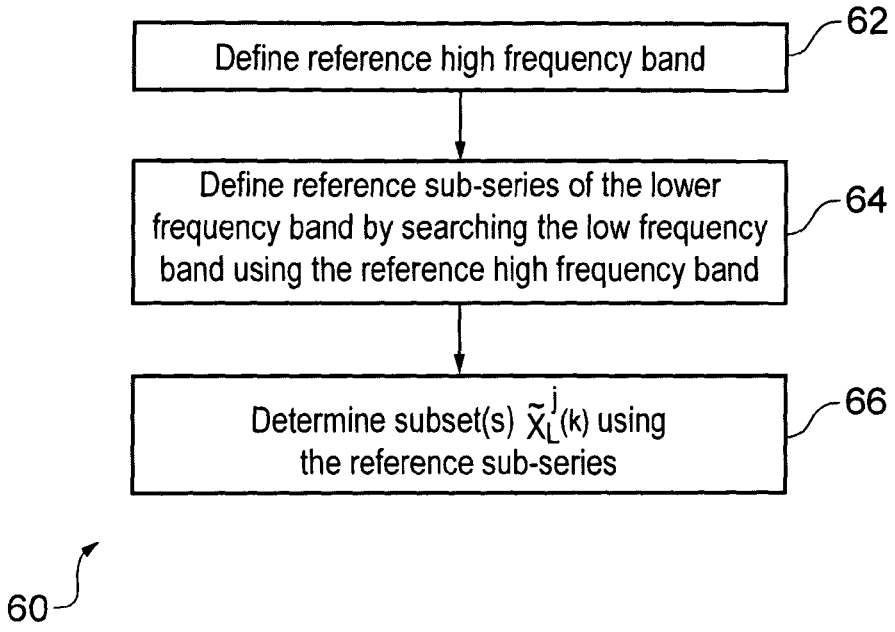
FIG. 8 schematically illustrates a method for determining a reference sub-series within the lower series of samples that is used to select subsets of the lower series for use in parametrically encoding a higher series of samples.

FIG. 8 schematically illustrates a method 60 for determining a reference sub-series $\tilde{X}_L^J(d_{max})$ within the lower series of samples $\hat{X}_L(k)$ that is used to select the reduced subsets $\tilde{X}_L^j(k)$ for use in parametrically encoding the higher series of samples $X_H^j(k)$.

At block 62 a 'reference' high frequency band $X_H^J(k)$ is defined by determining the index J. The reference high frequency band $X_H^J(k)$ may be any one of the high frequency bands $X_H^j(k)$. It may be a fixed one of the high frequency bands such as, for example, the lowest frequency high frequency band e.g. J always equals 0. It may alternatively be adaptively selected based on the characteristics of the high frequency bands. For example, a similarity measure such as a cross-correlation may be used to identify the high frequency band that has the greatest similarity to the other high frequency bands and this high frequency band may be set as the reference high frequency band. The high frequency band that has the greatest similarity to the other high frequency bands may be the high frequency band with the highest cross-correlation with another high frequency band, alternatively it may be the high frequency band with the highest median or mean cross-correlation with the other high frequency bands.

Next at block 64, the sub-series search block 22 processes the full low frequency band (the lower series of samples $\hat{X}_L(k)$) and the reference high frequency band (the higher series of samples $X_H^J(k)$) to parametrically encode the higher series of samples $X_H^J(k)$ by identifying a 'matching' reference sub-series of the lower series of samples $\hat{X}_L(k)$). The sub-series search block 22 determines a similarity cost function S(d), that is dependent upon the higher series of samples $X_H^J(k)$ and a putative sub-series $X_L(k+d)$ of the lower series of samples $\hat{X}_L(k)$, for each one of a plurality of putative sub-series of the lower series $\hat{X}_L(k)$. It selects the best sub-series $X_L^J(d_{max})=X_L(k+d_{max})$ by choosing the putative sub-series $X_L(k+d)$ of the lower series $\hat{X}_L(k)$ having the best similarity cost function S(d). It identifies the position of the selected putative sub-series $X_L^J(d_{max})$ within the lower series of samples $\hat{X}_L(k)$.

The example of the suitable method 30 illustrated in FIG. 7 may be adapted so that at block 32, instead of the subset $\tilde{X}_L^j(k)$ of the lower series of samples $\hat{X}_L(k)$ being selected and obtained, the lower series of samples $\hat{X}_L(k)$ is obtained for subsequent use at block 40. At block 40, a similarity cost function S(d) that is dependent upon the higher series of samples $X_H^J(k)$ and the current putative sub-series $X_L^J(k+d)$ of the lower series of samples $\hat{X}_L(k)$ is determined.

Consequently a full or exhaustive search of the lower series of samples $X_L^j(k)$ using the reference high frequency band (the higher series of samples $X_H^J(k)$) produces a reference sub-series $X_L^J(d_{max})$ within the lower series of samples $\hat{X}_L(k)$ for parametrically encoding the higher series of samples $X_H^j(k)$.

Next at block 66, the subsets $\tilde{X}_L^j(k)$ of the lower series of samples $X_L^j(k)$ are selected using information identifying the reference sub-series $X_L^j(d_{max})$ such as $d_{max}(j)$. The subsets $\tilde{X}_L^j(k)$ are in the neighborhood of the reference sub-series $X_L^J(d_{max})$. Search ranges SR define the number of search positions for the subsets $\tilde{X}_L^j(k)$ i.e. the extent of which $\tilde{X}_L^j(k)$ is greater than $X_H^j(k)$. The number of search positions may, for example, be between 30% and 150% of the size of the subsets $\tilde{X}_L^j(k)$ and include at least some of the reference sub-series $X_L^J(d_{max})$.

In one embodiment, each one of a plurality of predetermined, non-overlapping ranges $R_{Jj}$ of the reference sub-series $X_L^J(d_{max})$ is associated in a data structure with predetermined, non-overlapping search ranges SR defining the subsets $\tilde{X}_L^j(k)$. If the reference sub-series $X_L^J(d_{max})$ falls within a particular range then this defines the set of subsets $\tilde{X}_L^j(k)$.

Tables 1 and 2 below illustrate possible examples of the data structures. For these examples, the high frequency bands j=0, 1, 2, 3 have respective lengths of 40, 70, 70, and 100 samples that cover the 280-sample high-frequency region in the transform domain (corresponding to frequency ranges 7-8 (k)Hz, 8-9.75 (k)Hz, 9.75-11.5 (k)Hz and 11.5-14 (k)Hz, respectively of the overall high frequency range of 7-14 (k)Hz).

TABLE 1

| | | SR defining the subsets $\tilde{X}_L^j$ (k). | | | |
|---|---|---|---|---|---|
| J | $R_{Jj}$ | j = 0 | j = 1 | j = 2 | j = 3 |
| 0 | 0 . . . 57 | — | 0 . . . 57 | 0 . . . 57 | 0 . . . 63 |
| | 58 . . . 115 | — | 58 . . . 115 | 58 . . . 115 | 58 . . . 121 |
| | 116 . . . 175 | — | 116 . . . 175 | 116 . . . 175 | 116 . . . 179 |
| | 176 . . . 239 | — | 167 . . . 209 | 167 . . . 209 | 116 . . . 179 |
| 1 | 0 . . . 57 | 0 . . . 57 | — | 0 . . . 57 | 0 . . . 63 |
| | 58 . . . 115 | 58 . . . 115 | — | 58 . . . 115 | 58 . . . 121 |
| | 116 . . . 175 | 116 . . . 175 | — | 116 . . . 175 | 116 . . . 179 |
| | 176 . . . 209 | 176 . . . 239 | — | 176 . . . 209 | 116 . . . 179 |
| 2 | 0 . . . 57 | 0 . . . 57 | 0 . . . 57 | — | 0 . . . 63 |
| | 58 . . . 115 | 58 . . . 115 | 58 . . . 115 | — | 58 . . . 121 |
| | 116 . . . 175 | 116 . . . 175 | 116 . . . 175 | — | 116 . . . 179 |
| | 176 . . . 209 | 176 . . . 239 | 176 . . . 209 | — | 116 . . . 179 |
| 3 | — | | — | | |

TABLE 2

| | | SR defining the subsets $\tilde{X}_L^j$ (k). | | | |
|---|---|---|---|---|---|
| J | $R_{Jj}$ | j = 0 | j = 1 | j = 2 | j = 3 |
| 0 | 0 . . . 57 | — | 0 . . . 63 | 0 . . . 63 | 0 . . . 63 |
| | 58 . . . 115 | — | 58 . . . 121 | 58 . . . 121 | 58 . . . 121 |
| | 116 . . . 175 | — | 117 . . . 180 | 117 . . . 180 | 116 . . . 179 |
| | 176 . . . 239 | — | 146 . . . 209 | 146 . . . 209 | 116 . . . 179 |
| 1 | 0 . . . 57 | 0 . . . 63 | — | 0 . . . 63 | 0 . . . 63 |
| | 58 . . . 115 | 61 . . . 124 | — | 58 . . . 121 | 58 . . . 121 |
| | 116 . . . 175 | 122 . . . 185 | — | 117 . . . 180 | 116 . . . 179 |
| | 176 . . . 209 | 176 . . . 239 | — | 146 . . . 209 | 116 . . . 179 |

TABLE 2-continued

| J | $R_{Jj}$ | SR defining the subsets $\tilde{X}_L^j(k)$. j = 0 | j = 1 | j = 2 | j = 3 |
|---|---|---|---|---|---|
| 2 | 0 . . . 57 | 0 . . . 63 | 0 . . . 63 | — | 0 . . . 63 |
| | 58 . . . 115 | 61 . . . 124 | 58 . . . 121 | — | 58 . . . 121 |
| | 116 . . . 175 | 122 . . . 185 | 117 . . . 180 | — | 116 . . . 179 |
| | 176 . . . 209 | 176 . . . 239 | 146 . . . 209 | — | 116 . . . 179 |
| 3 | — | | — | | |

It should be noticed that the search ranges SR defining the subsets $\tilde{X}_L^j(k)$ vary with j and also vary with J (the referenced sub-series) and also vary with $R_{Jj}$ In the examples above, four search ranges for the search are defined, to be selected in dependence of the high frequency band J selected as the reference high frequency band and in dependence of the range $R_{Jj}$ within which the reference sub-series falls. However, in embodiments of the invention, any number of search ranges may be defined/used and the search range used may be adapted Furthermore, in the examples above, the adaptive search ranges $R_{Jj}$ for a given high frequency band j are always the same regardless of the high frequency band J selected as the reference high frequency band However, in another embodiment of the invention, the adaptive search range $R_{Jj}$ for a given high frequency band j may also be based on the high frequency band J selected as the reference high frequency band.

In another embodiment, the ranges $R_{Jj}$ defining the subsets $\tilde{X}_L^j(k)$ are dynamically determined.

In yet another embodiment, the search ranges SR are dynamically determined. The lengths of the search ranges SR may be set by the bit rate.

The adaptive search ranges $R_{Jj}$ may be based on the exact value of the best-match index $d_{max}$ determined for the high frequency band J selected as the reference high frequency band instead of using fixed predetermined search ranges. For example, the adaptive search range $R_{Jj}$ may be defined to be "around" the best match index $d_{max}$ determined for the high frequency band J, e.g. $d_{max}-D^{lo}_k \ldots d_{max}+D^{hi}_k$, where $d_{max}$ denotes the best match index determined for the high frequency band J, $D^{lo}_j$ defines a predetermined lower limit of the adaptive search range for frequency band j, and $D^{hi}_j$, defines a predetermined upper limit of the adaptive search range for frequency band j. Furthermore, $D^{lo}_j$ and $D^{hi}_j$ may be the same or different and they may be dependent on the frequency band J.

In some embodiments, the full search may be performed for more than one of the subbands j. This could potentially improve the quality over the most basic implementation, while the reduction in complexity would not be quite as significant. In one of these embodiments, the full search may be performed for the most perceptually important band(s) in addition to being performed to determine the reference low frequency band. In another of these embodiments, there may be more than one value of J and more than one reference high frequency band and more than one reference low frequency band may be used In the similarity cost function S(d) defined at Equation (1A) or (1B), the current putative sub-series $\tilde{X}_L(k+d)$ and the subset $X_H^j(k)$ of the higher series of samples are derived from the same frame of digital audio 3. In other implementations, the search for the putative sub-series $\tilde{X}_L$ (k+d) that best matches the higher series of samples subset $X_H^j(k)$ may range across multiple audio frames.

In the described implementation, the size of the higher series of samples and the size of the lower series of samples are predetermined. In other implementations the size of higher series and/or the size of the lower series may be dynamically varied.

Scaling

Referring back to FIG. 2, in this example, the most similar match $X_L^j(d_{max})=\tilde{X}_L(k+d_{max})$ may be scaled using two scaling factors $\alpha_1(j)$ and $\alpha_2(j)$. The first scaling factor $\alpha_1(j)$ may be determined in the scaling parameter block 24. The second scaling factor $\alpha_2(j)$ may be determined in the scaling parameter block 26.

The first scaling factor $\alpha_1(j)$ is dependent upon the selected subset $\tilde{X}_L^j(k)$ of the lower series of samples $\hat{X}_L(k)$. The first scaling factor is a function of $\tilde{X}_L^j(k)$ as opposed to being a function of $\hat{X}_L(k)$ The first scaling factor operates on the linear domain to match the high amplitude peaks in the spectrum:

Equation (2) expresses an example of a suitable first scaling factor as a normalized cross-correlation.

$$\alpha_1(j) = \frac{\sum_{k=0}^{n_j-1} \left(X_H^j(k)\tilde{X}_L^j(k)\right)}{\sum_{k=0}^{n_j-1} \tilde{X}_L(d+k)^2}. \tag{2}$$

Notice that $\alpha_1(j)$ can get both positive and negative values.

The numerator of Equation (1A) or (1B) and Equation (2) are the same. The denominators of Equation (1A) or (1B) and Equation (2) are related. The numerator and/or the denominator calculated for $S(d_{max})$ in Equation (1A) may be re-used to calculate the first scaling factor.

The second scaling factor $\alpha_2(j)$ operates on the logarithmic domain and is used to provide better match with the energy and the logarithmic domain shape.

Equation (3) expresses an example of a suitable second scaling factor:

$$\alpha_2(j) = \frac{\sum_{k=0}^{n_j-1} \left(\left(\log_{10}\left(\left|a_1(j)\tilde{X}_L^j(k)\right|\right) - M_j\right)\left(\log_{10}\left(\left|X_H^j(k)\right|\right) - M_j\right)\right)}{\sum_{k=0}^{n_j-1} \left(\log_{10}\left(\left|\alpha_1(j)\tilde{X}_L^j(k)\right|\right) - M_j\right)^2} \tag{3}$$

where $$M_j = \max_k\left(\log_{10}\left(\left|\alpha_1(j)\tilde{X}_L^j(k)\right|\right)\right).$$

The overall synthesized sub band $\hat{X}_H^j(k)$ is then obtained as $$X_H^j(k)=\zeta(k)10^{\alpha 2(j)(\log 10(|\alpha 1(j)\tilde{X}_{L_j}(k)|)-Mj)+Mj} \tag{4}$$

where $\zeta(k)$ is −1 if a $\alpha_1(j)\hat{X}_L^j(k)$ is negative and otherwise 1.

The output of each of the parametric coding blocks $\mathbf{14}_j$ is a set of parameters representing the higher frequency band $\mathbf{15}_j$. The parameters representing the higher frequency band $\mathbf{15}_j$ include the parameter $d_{max}(j)$ which identifies a sub-series of the lower series of samples $\hat{X}_L(k)$ suitable for producing the higher series of samples $X_H^j(k)$, and the scaling factors $\alpha_1(j)$, $\alpha_2(j)$.

The audio decoding apparatus 4 processes the encoded data 5 to produce digital audio 7. The encoded data 5 comprises encoded audio 13 (encoding the lower series of samples $X_L(k)$) and the parameters representing the higher frequency band $\mathbf{15}_j$.

The decoding apparatus 4 is configured to decode the encoded audio 13 to produce the lower series of samples $\hat{X}_L(k)$. The decoding apparatus 4 is configured to replicate the higher series of samples $X_H^j(k)$ forming the higher frequency spectral band using the sub-series $\hat{X}_L(k)$ of the lower series of samples identified by the parameter $d_{max}(j)$.

Referring to FIGS. 1 and 2, each of the parametric coding blocks $\mathbf{14}_1, \mathbf{14}_2 \ldots \mathbf{14}_M$, may be provided as a distinct block or a single block may be reused with different inputs as the respective parametric coding blocks $\mathbf{14}_1, \mathbf{14}_2 \ldots \mathbf{14}_M$. A block may be a hardware block such as circuitry. A block may be a software block implemented via computer code.

Referring to FIG. 2, the subset selection block 20 and the sub series search block 22 may be implemented by a single hardware block or by a single software block. Alternatively, the subset selection block 20 and the sub series search block 22 may be implemented using distinct hardware blocks and/or software blocks. A hardware block comprises circuitry.

Referring to FIG. 2, the scaling parameter blocks 24, 26 are optional. When present, one or more of the scaling parameter blocks may be integrated with the sub series search block 22 or may be integrated into a single block.

A software block or software blocks, a hardware block or hardware blocks and a mixture of software block(s) and hardware blocks may be provided by the apparatus 2. Examples of apparatus include modules, consumer devices, portable devices, personal devices, audio recorders, audio players, multimedia devices etc.

The apparatus 2 may comprise: circuitry 22 configured to process a selected subset $\tilde{X}_L^j(k)$ of the lower series of samples forming a lower spectral band of an audio signal and a series $X_H^j(k)$ of samples forming a higher frequency spectral band of the audio signal to parametrically encode the series of samples $X_H^j(k)$ forming the higher frequency spectral band by identifying a sub-series $\hat{X}_L(d_{max})$ of the selected subset $\tilde{X}_L^j(k)$ of the lower series of samples using a parameter $d_{max}(j)$.

Figure 5:
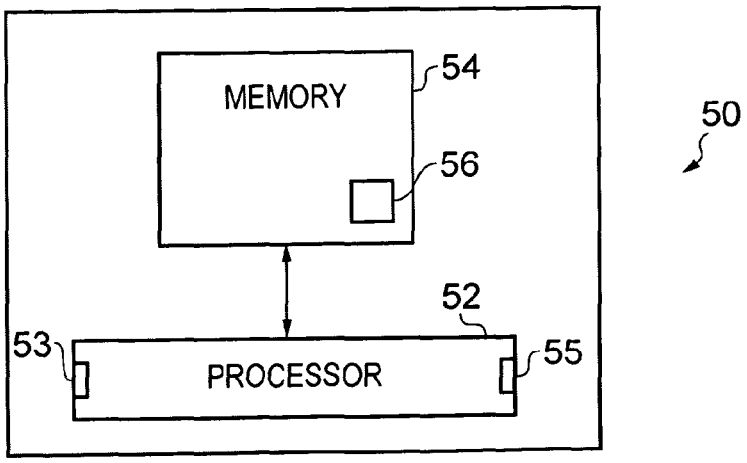
FIG. 5 schematically illustrates a controller.

FIG. 5 schematically illustrates a controller 50 suitable for use in an encoding apparatus 2 and/or a decoding apparatus.

Implementation of a controller can be in hardware alone (a circuit, a processor . . . ), have certain aspects in software including firmware alone or can be a combination of hardware and software (including firmware).

A controller may be implemented using instructions that enable hardware functionality, for example, by using executable computer program instructions in a general-purpose or special-purpose processor that may be stored on a computer readable storage medium (disk, memory etc) to be executed by such a processor.

The controller 50 illustrated in FIG. 5 comprises a processor 52 and a memory 54.

The processor 52 is configured to read from and write to the memory 54. The processor 52 may also comprise an output interface 53 via which data and/or commands are output by the processor 52 and an input interface 55 via which data and/or commands are input to the processor 52.

The memory 54 stores a computer program 56 comprising computer program instructions that, when loaded into the processor 52, control the operation of the encoding apparatus 2 and/or decoding apparatus 4. The computer program instructions 56 provide the logic and routines that enable the apparatus to perform the methods illustrated in FIGS. 1 to 4 and 7. The processor 52 by reading the memory 54 is able to load and execute the computer program 56.

Figure 6:
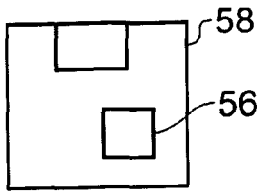
FIG. 6 schematically illustrates a computer readable physical medium.

The computer program may arrive at the apparatus via any suitable delivery mechanism 58. The delivery mechanism 58 may be, for example, a computer-readable physical storage medium as illustrated in FIG. 6, a computer program product, a memory device, a record medium such as a CD-ROM or DVD, an article of manufacture that tangibly embodies the computer program 56. The delivery mechanism may be a signal configured to reliably transfer the computer program 56.

The apparatus may propagate or transmit the computer program 56 as a computer data signal.

Although the memory 54 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Although a coding apparatus 2 and a decoding apparatus 4 have been described, it should be appreciated that a single apparatus may have the functionality to act as the coding apparatus and/or the decoding apparatus 4.

As used here 'module' refers to a unit or apparatus that excludes certain parts/components that would be added by an end manufacturer or a user.

The blocks illustrated in the Figs may represent steps in a method and/or sections of code in the computer program 56. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

processing a lower series of samples forming a lower frequency spectral band of the audio signal and multiple different higher series of samples forming multiple different higher frequency spectral bands of the audio signal to parametrically encode the multiple higher series of samples, comprising selecting a respective subset of the lower series of samples for each one of said multiple higher series of samples by;

defining a reference higher series of samples forming a reference higher frequency spectral band of the audio signal;

determining a reference sub-series of the lower series of samples by searching said lower series of samples using the reference higher series of samples; and selecting the respective subset of the lower series of samples for each of the multiple higher series of samples based upon the reference sub-series of the lower series of samples;

processing each of said selected subsets of the lower series of samples and the respective higher series of samples to select multiple sub-series of the lower series of samples; and parametrically encoding the multiple higher series of samples by identifying the multiple selected sub-series of the lower series of samples.

2. A method as claimed in claim 1, further comprising, for each of the multiple higher series of samples:

creating the selected subset by selecting a subset of said lower series of samples;

searching the selected subset of the lower series of samples using a respective higher series of samples to select a sub-series of selected subset of the lower series of samples; and parametrically encoding the respective higher series of samples by identifying the selected sub-series of the selected subset of the lower series of samples.

3. A method as claimed in claim 1 further comprising psychoacoustic encoding and then decoding the lower series of samples before processing the selected subset of the lower series of samples and the higher series of samples to parametrically encode the higher series of samples by identifying a sub-series of the lower series of samples.

4. A method as claimed in claim 1, further comprising selecting a subset of a lower series of samples by including a reduced range of psycho-acoustically significant samples.

5. A method as claimed in claim 1, wherein defining the reference higher series of samples forming a reference higher frequency spectral band of the audio signal is based on a similarity measure that identifies the high frequency band that has the greatest similarity to the other high frequency bands.

6. A method as claimed in claim 1, wherein the selected subset of the lower series of samples includes at least a portion of the reference sub-series of the lower series of samples and is significantly smaller than the lower series of samples.

7. A method as claimed in claim 1, wherein the selected subset of the lower series of samples has one of a plurality of predetermined, non-overlapping ranges.

8. A method as claimed in claim 1, further comprising selecting a subset of a lower series of samples by selecting one of a plurality of different methodologies for determining a subset of a lower series of samples.

9. A method as claimed in claim 1, wherein processing the selected subset of the lower series of samples and the higher series of samples to parametrically encode the higher series of samples by identifying a sub-series of the lower series of samples comprises:

determining a similarity cost function, that is dependent upon the higher series of samples and a putative sub-series of the selected subset of the lower series of samples, for each one of a plurality of putative sub-series of the lower series;

selecting the putative sub-series of the selected subset of the lower series having the best similarity cost function; and identifying the position of the selected putative sub-series within the lower series using a parameter.

10. A method as claimed in claim 9, wherein the similarity cost function, comprises processing of each of the samples in the higher series of samples with the respective corresponding sample in the putative sub-series.

11. A method as claimed in claim 9, wherein the similarity cost function, comprises correlation of the higher series of samples and the putative sub-series.

12. A method as claimed in claim 11 wherein at least part of the correlation result for the selected putative sub-series is re-used to calculate a scaling factor.

13. A system comprising:

an encoding apparatus configured to process a lower series of samples forming a lower frequency spectral band of an audio signal and multiple different higher series of samples forming multiple different higher frequency spectral bands of the audio signal to parametrically encode the multiple higher series of samples, the encoding apparatus configured to select a respective subset of the lower series of samples for each one of said multiple higher series of samples by;

defining a reference higher series of samples forming a reference higher frequency spectral band of the audio signal;

determining a reference sub-series of the lower series of samples by searching said lower series of samples using the reference higher series of samples; and selecting the respective subset of the lower series of samples for each of the multiple higher series of samples based upon the reference sub-series of the lower series of samples;

process each of said selected subsets of the lower series of samples and the respective higher series of samples to select multiple sub-series of the lower series of samples; and parametrically encode the multiple higher series of samples by identifying, using respective parameters, the multiple selected sub-series of the lower series of samples; and a decoding apparatus configured to replicate the multiple higher series of samples forming the higher frequency spectral bands using the multiple sub-series of the lower series of samples identified by the respective parameters.

14. The system as claimed in claim 13, wherein the decoding apparatus is configured to decode data received from the encoding apparatus to produce the lower series of samples from which the multiple sub-series of the lower series of samples are obtained.

15. An apparatus comprising:

circuitry configured to process a lower series of samples forming a lower frequency spectral band of an audio signal and multiple different higher series of samples forming multiple different higher frequency spectral bands of the audio signal to parametrically encode the multiple series of samples by identifying multiple sub-series of the selected subset of the lower series of samples, said circuitry configured to select a respective subset of the lower series of samples for each one of said multiple higher series of samples by;

defining a reference higher series of samples forming a reference higher frequency spectral band of the audio signal;

determining a reference sub-series of the lower series of samples by searching said lower series of samples using the reference higher series of samples; and selecting the respective subset of the lower series of samples for each of the multiple higher series of samples based upon the reference sub-series of the lower series of samples;

process each of said selected subsets of the lower series of samples and the respective higher series of samples to select multiple sub-series of the lower series of samples; and parametrically encode the multiple higher series of samples by identifying the multiple selected sub-series of the lower series of samples.

16. A computer readable physical medium tangibly embodying a computer program which when run on a processor enables the processor to process a lower series of samples forming a lower frequency spectral band of an audio signal and multiple different higher series of samples forming multiple different higher frequency spectral bands of the audio signal to parametrically encode the series of samples, said processing comprising selecting a respective subset of the lower series of samples for each one of said multiple higher series of samples by;

defining a reference higher series of samples forming a reference higher frequency spectral band of the audio signal;

determining a reference sub-series of the lower series of samples by searching said lower series of samples using the reference higher series of samples; and selecting the respective subset of the lower series of samples for each of the multiple higher series of samples based upon the reference sub-series of the lower series of samples;

processing each of said selected subsets of the lower series of samples and the respective higher series of samples to select multiple sub-series of the lower series of samples; and parametrically encoding the multiple higher series of samples by identifying the multiple selected sub-series of the lower series of samples.

* * * * *